US010361486B2

(12) United States Patent
Huang et al.

(10) Patent No.: US 10,361,486 B2
(45) Date of Patent: Jul. 23, 2019

(54) EXTERNAL ANTENNA AND METHOD FOR MANUFACTURING THE SAME

(71) Applicants: Tyco Electronics (Shanghai) Co. Ltd., Shanghai (CN); Tyco Electronics Japan G.K., Kanagawa (JP)

(72) Inventors: Jianlin Huang, Shanghai (CN); Yoshinao Takada, Kanagawa (JP); Jlan Yu, Shanghai (CN)

(73) Assignees: Tyco Electronics Japan G.K., Kanagawa (JP); Tyco Electronics (Shanghai) Co. Ltd., Shanghai (CN)

( * ) Notice: Subject to any disclaimer, the term of this patent is extended or adjusted under 35 U.S.C. 154(b) by 252 days.

(21) Appl. No.: 15/331,193

(22) Filed: Oct. 21, 2016

(65) Prior Publication Data

US 2017/0117631 A1 Apr. 27, 2017

(30) Foreign Application Priority Data

Oct. 22, 2015 (CN) ..... 2015 1 0690521

(51) Int. Cl.

| | |
|---|---|
| ***H01Q 1/24*** | (2006.01) |
| ***H01Q 1/38*** | (2006.01) |
| ***H01Q 7/00*** | (2006.01) |
| ***H01Q 7/08*** | (2006.01) |

(52) U.S. Cl.
CPC ..... *H01Q 7/08* (2013.01); *H01Q 1/242* (2013.01); *H01Q 1/38* (2013.01); *H01Q 7/00* (2013.01)

(58) Field of Classification Search
CPC ..... H01Q 7/02; H01Q 7/08
See application file for complete search history.

(56) References Cited

U.S. PATENT DOCUMENTS

| | | | | |
|---|---|---|---|---|
| 7,081,855 | B2 * | 7/2006 | Murray | H01Q 1/242 343/702 |
| 8,368,613 | B2 * | 2/2013 | Hornung | H01Q 1/1207 343/906 |
| 9,450,307 | B2 * | 9/2016 | Petted | H01Q 9/0407 |

* cited by examiner

*Primary Examiner* — Jessica Han
*Assistant Examiner* — Amal Patel
(74) *Attorney, Agent, or Firm* — Barley Snyder

(57) ABSTRACT

An external antenna is disclosed. The external antenna has a coaxial conductor assembly, a flexible circuit board, a passive element, and a support tube. The coaxial conductor assembly has a coaxial cable including an external conductor and an internal conductor insulated from the external conductor. The flexible circuit board is connected with the coaxial conductor assembly. The passive element is attached to the flexible circuit board and electrically connected to the external conductor and the internal conductor. The external conductor, the internal conductor, the flexible circuit board, and the passive element form an antenna loop. The flexible circuit board is wound around the support tube.

14 Claims, 12 Drawing Sheets

EXTERNAL ANTENNA AND METHOD FOR MANUFACTURING THE SAME

CROSS-REFERENCE TO RELATED APPLICATION

This application claims the benefit of the filing date under 35 U.S.C. § 119(a)-(d) of Chinese Patent Application No. 201510690521.9, filed on Oct. 22, 2015.

FIELD OF THE INVENTION

The present invention relates to an external antenna, and more particularly, to an external antenna disposed on a flexible printed circuit board.

BACKGROUND

Almost all portable electronic devices, such as mobile phones, tablets, laptops, or the like, employ an internal antenna. Internal antennas, however, have poor reception. External antennas, by contrast, generally can only operate in a partial frequency band range as opposed to a full frequency band range. Applications of external antennas are therefore limited.

SUMMARY

An object of the invention, among others, is to provide an external antenna with high sensitivity and operation frequencies in a full frequency band range. The disclosed external antenna has a coaxial conductor assembly, a flexible circuit board, a passive element, and a support tube. The coaxial conductor assembly has a coaxial cable including an external conductor and an internal conductor insulated from the external conductor. The flexible circuit board is connected with the coaxial conductor assembly. The passive element is attached to the flexible circuit board and electrically connected to the external conductor and the internal conductor. The external conductor, the internal conductor, the flexible circuit board, and the passive element form an antenna loop. The flexible circuit board is wound around the support tube.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an external antenna. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 15:
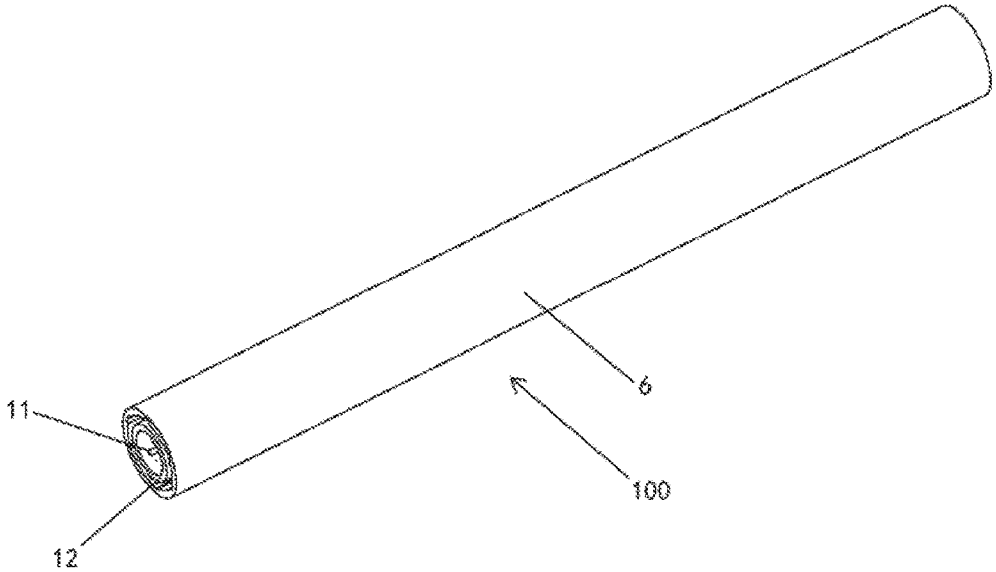
FIG. 15 is a perspective view of the external antenna.

An external antenna 100 according to an embodiment of the invention is shown generally in FIG. 15. The external antenna 100 comprises, as shown in FIGS. 1, 2, 5, 6, 8, 11, and 15, a coaxial conductor assembly 1, at least one passive element 2, a flexible circuit board 3, a support tube 4, and a protection tube 6. The major components of the invention will now be described in greater detail.

Figure 7:
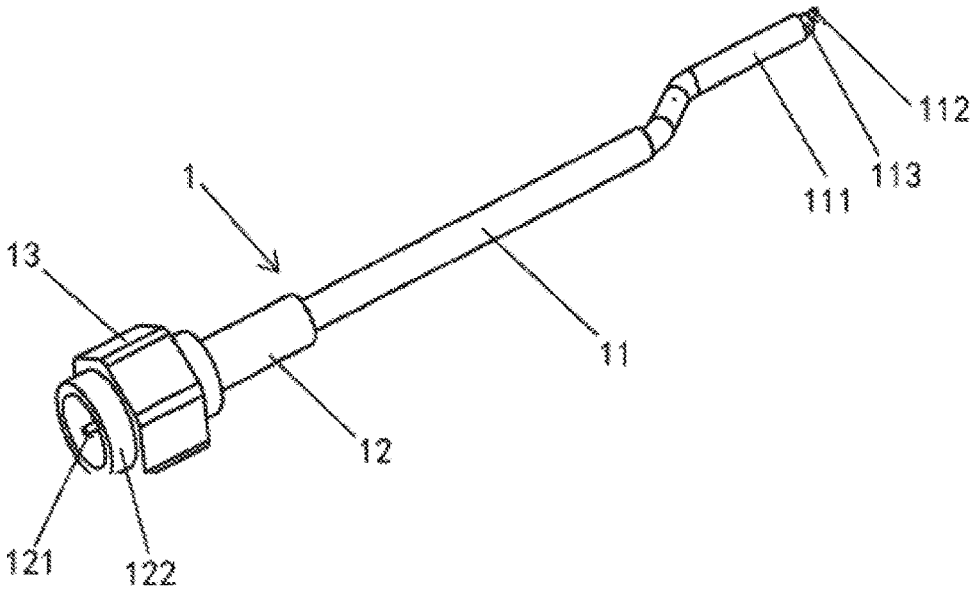
FIG. 7 is a perspective view of a coaxial conductor assembly of the external antenna.
Figure 8:
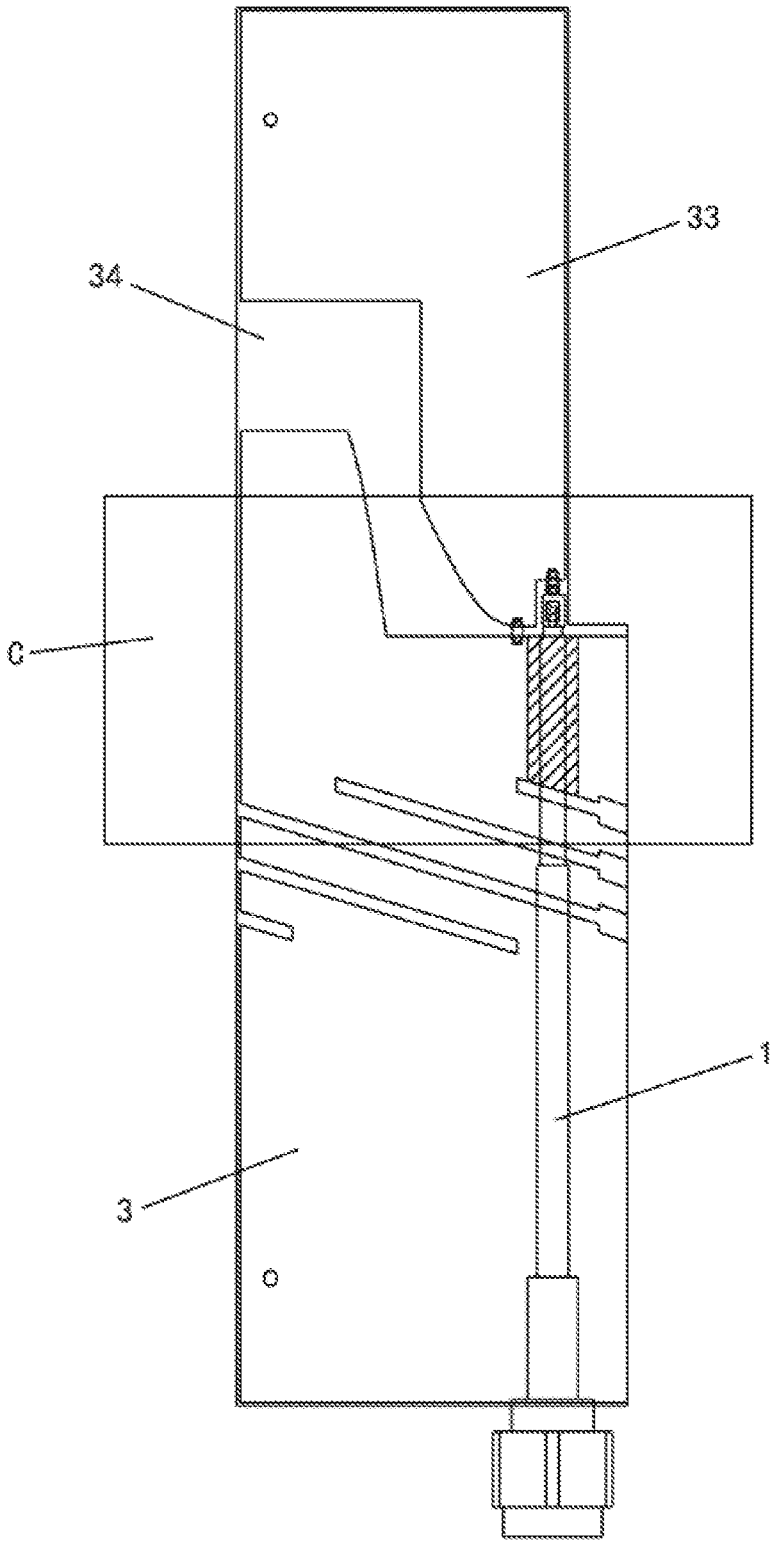
FIG. 8 is a plan view of the coaxial conductor assembly connected to the flexible circuit board of FIG. 5.
Figure 13:
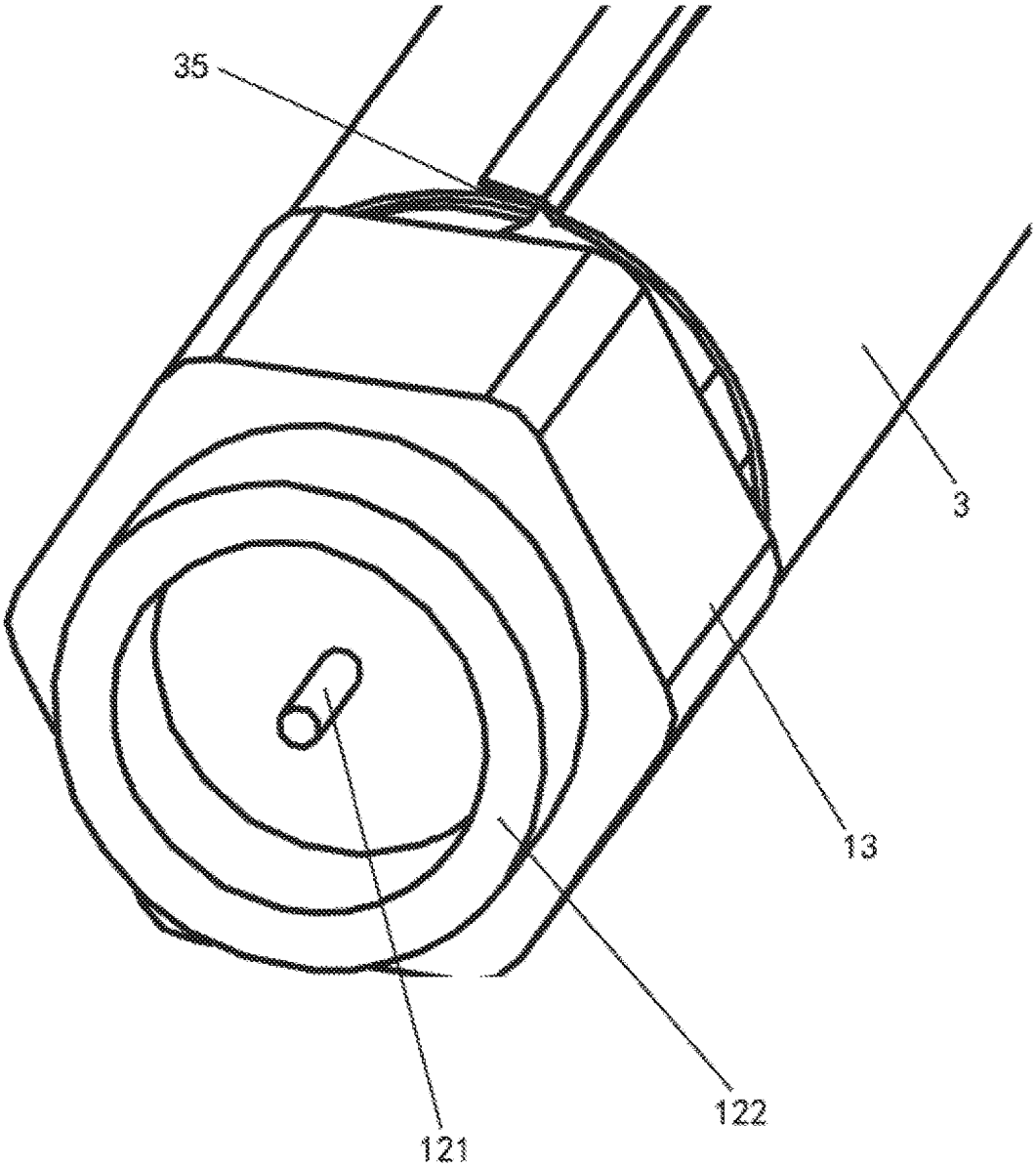
FIG. 13 is an enlarged view of a part D of FIG. 12.

The coaxial conductor assembly 1, as shown in FIGS. 7 and 13, has a coaxial cable 11 including an external conductor 111 and an internal conductor 112 insulated from the external conductor 111 through an insulation layer 113. The coaxial conductor assembly 1 also has a mounting fitting 12 mounted on an end of the coaxial cable 11. The mounting fitting 12 includes a conductive ferrule 121 electrically connected with the internal conductor 112 and a conductive cylinder 122 into which the coaxial cable 11 is partially inserted. The conductive cylinder 122 is electrically insulated from the ferrule 121 and electrically connected with the external conductor 111. The mounting fitting 12 may, for example, include a Sub-Miniature A (SMA) antenna interface. The conductive cylinder 122 is provided with internal threads. The coaxial conductor assembly 1 also has an insulation cylinder 13 fitted over the conductive cylinder 122.

Figure 4:
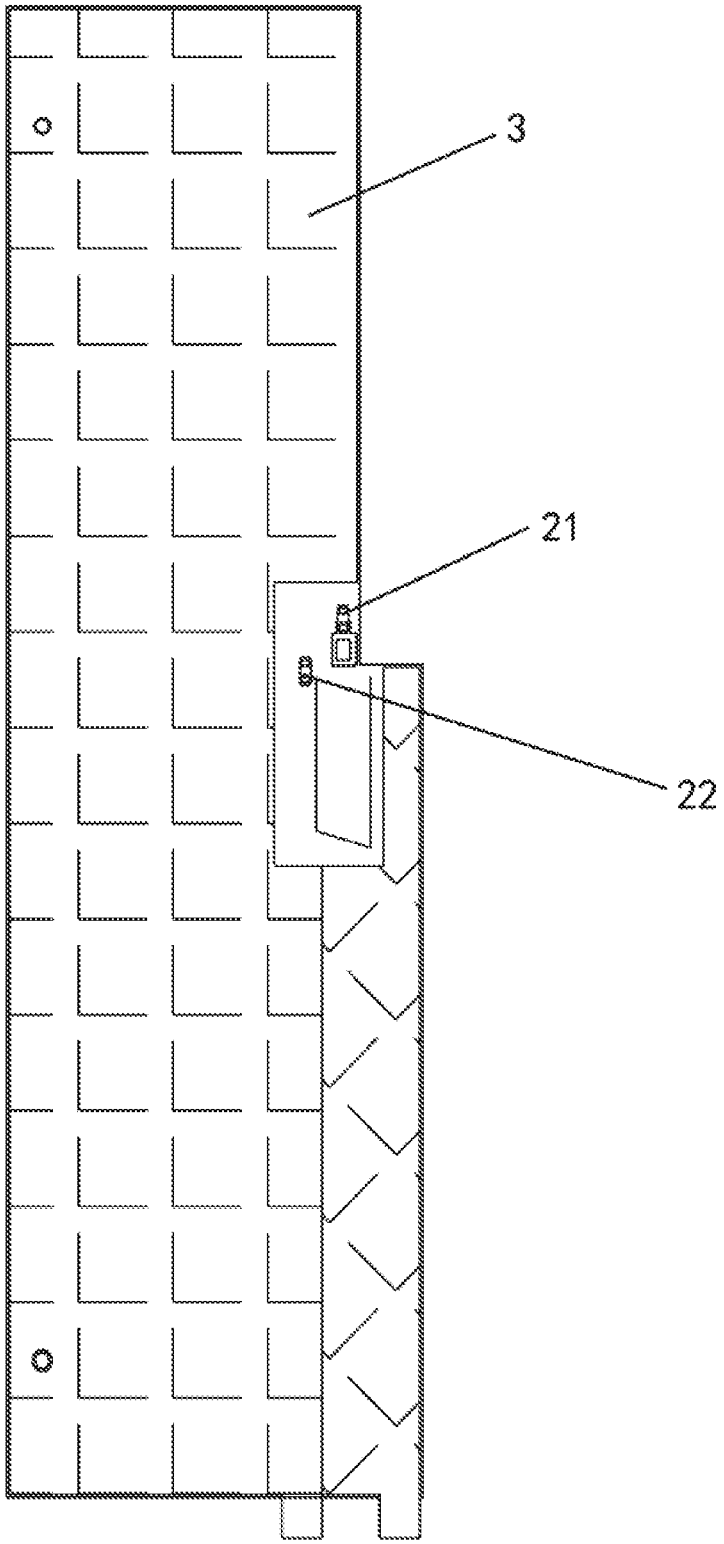
FIG. 4 is a plan view of a back surface of a flexible substrate of the flexible circuit board of FIG. 1.
Figure 6:
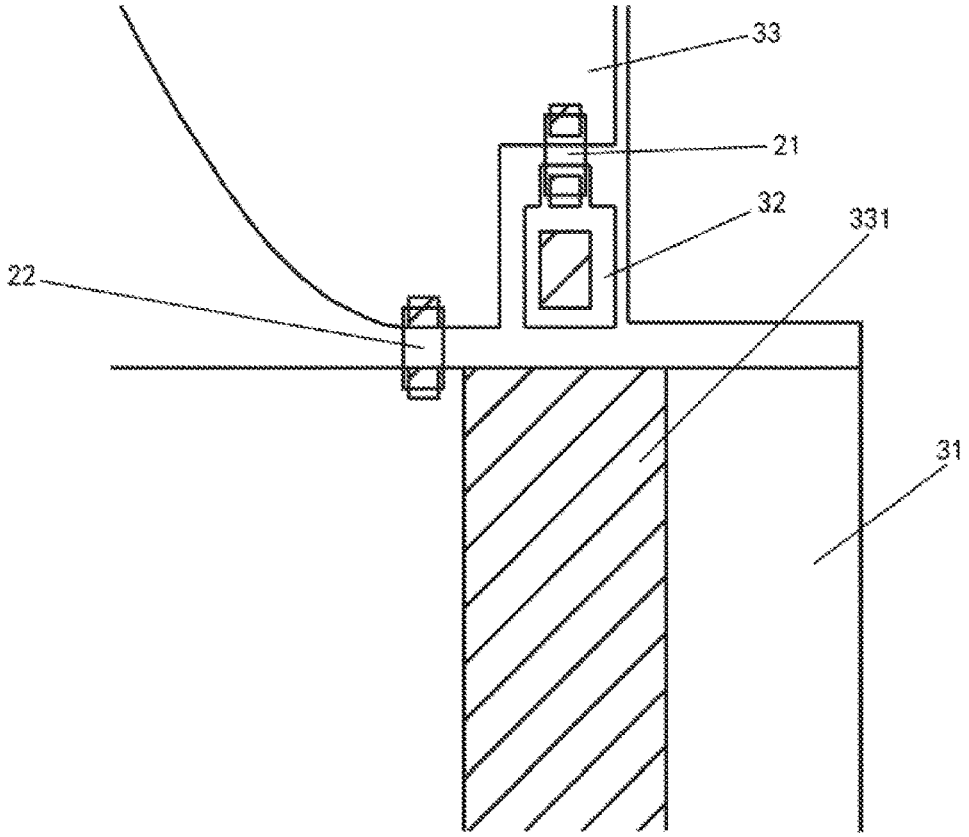
FIG. 6 is an enlarged view of a part B of FIG. 5.

The passive element 2, as shown in FIGS. 4 and 6, has a capacitive element 21 and an inductive element 22.

Figure 1:
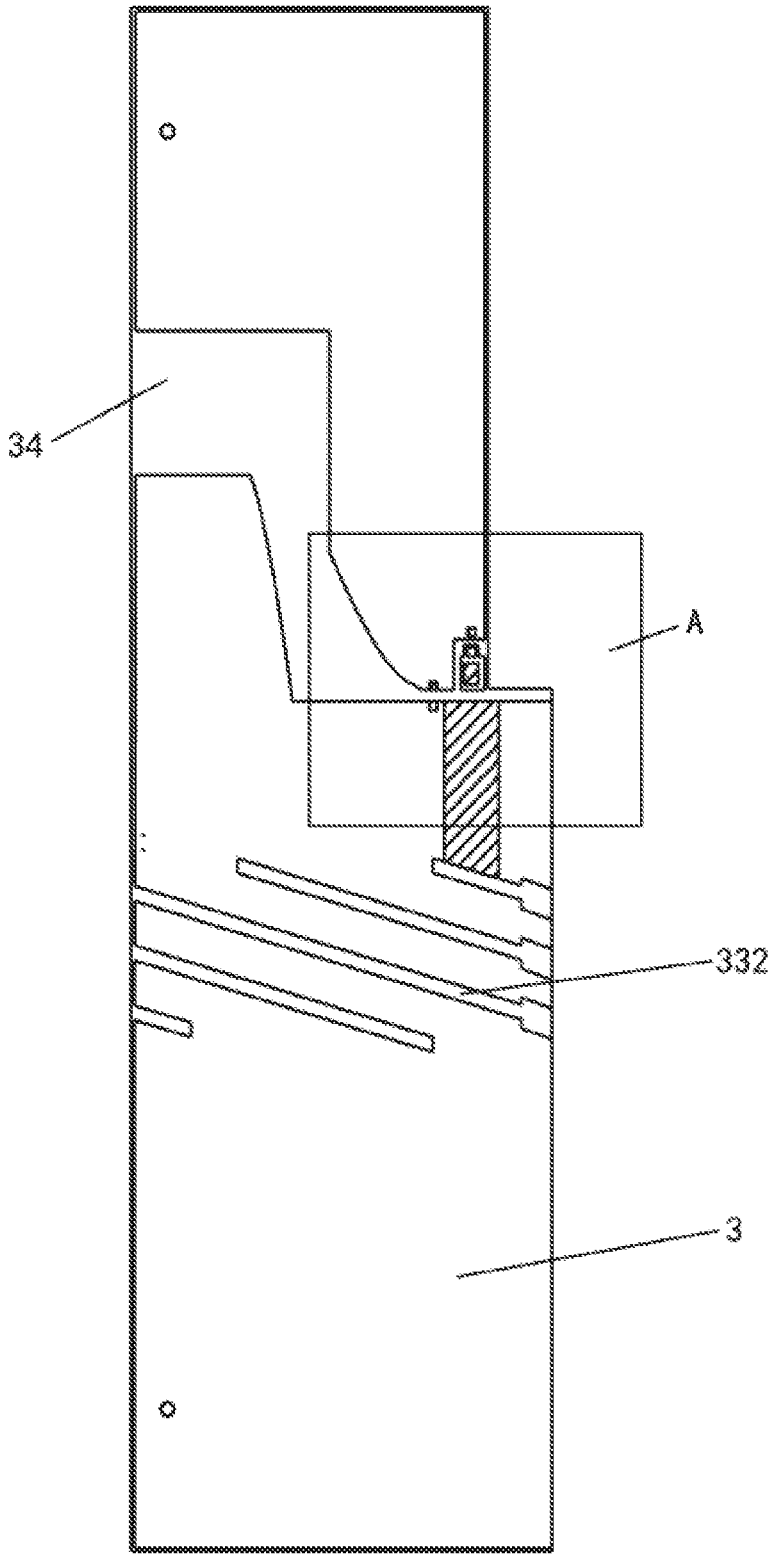
FIG. 1 is a plan view of a flexible circuit board of an external antenna according to the invention.
Figure 2:
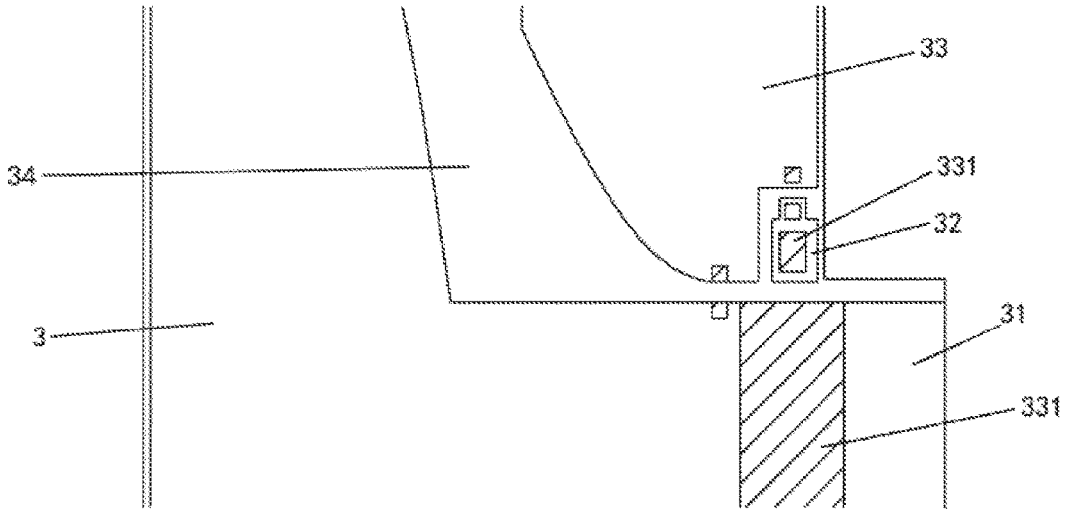
FIG. 2 is an enlarged view of a part A of FIG. 1.
Figure 3:
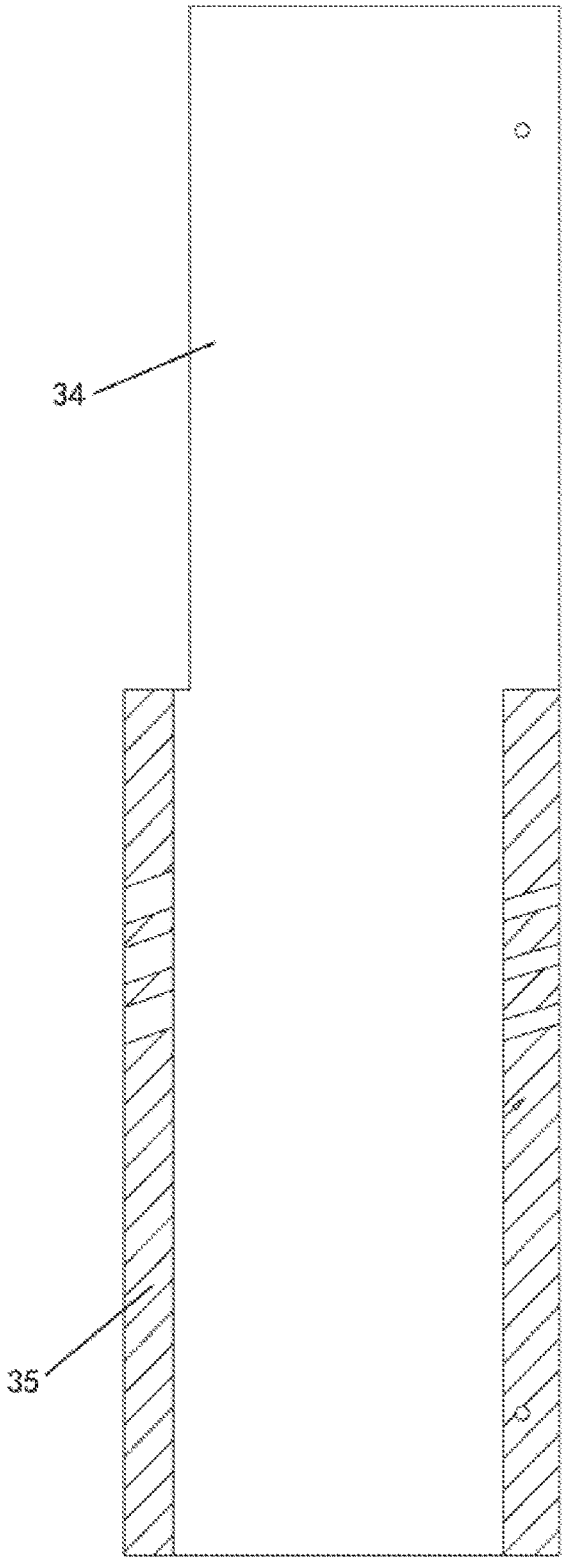
FIG. 3 is a plan view of a back surface of the flexible circuit board of FIG. 1.
Figure 5:
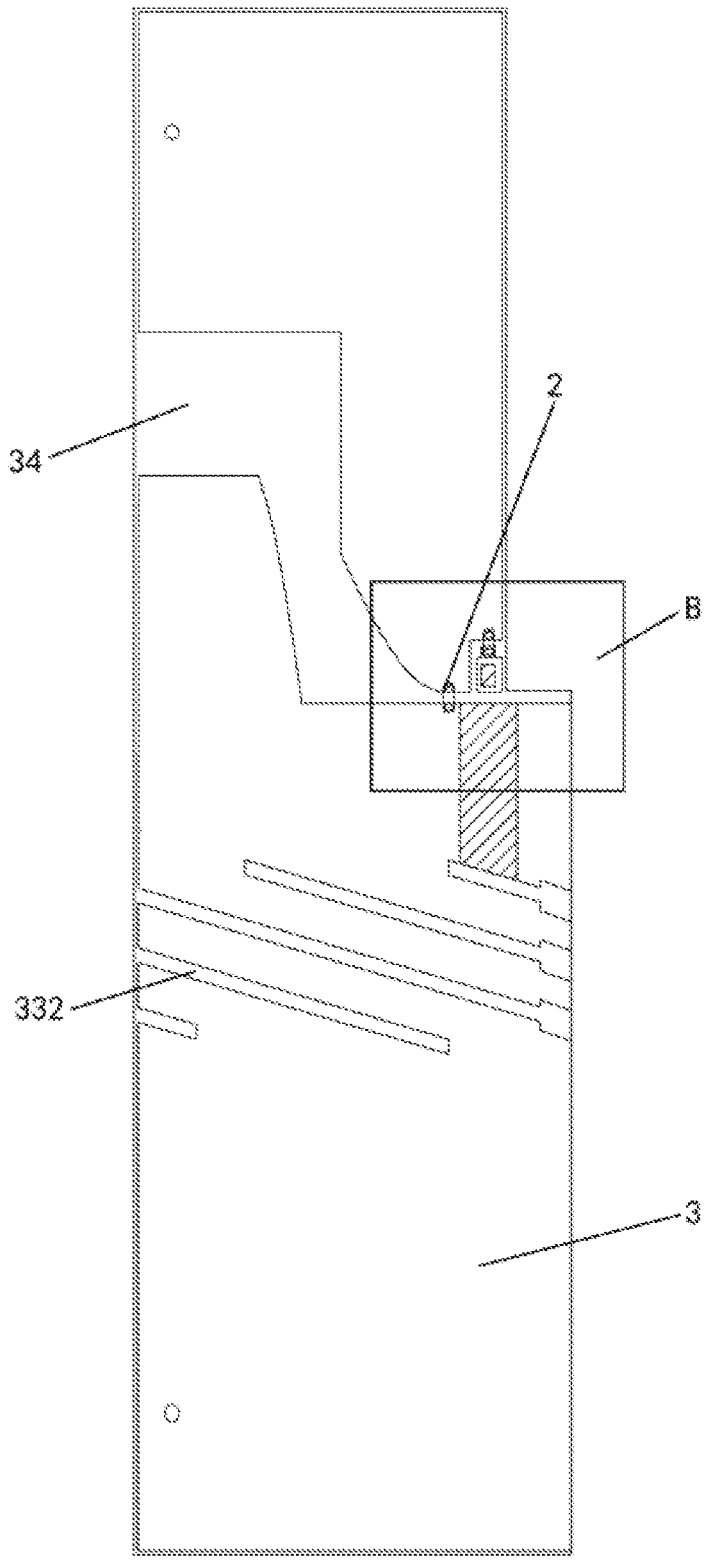
FIG. 5 is a plan view of the flexible circuit board of FIG. 1 connected with a passive element of the external antenna.
Figure 9:
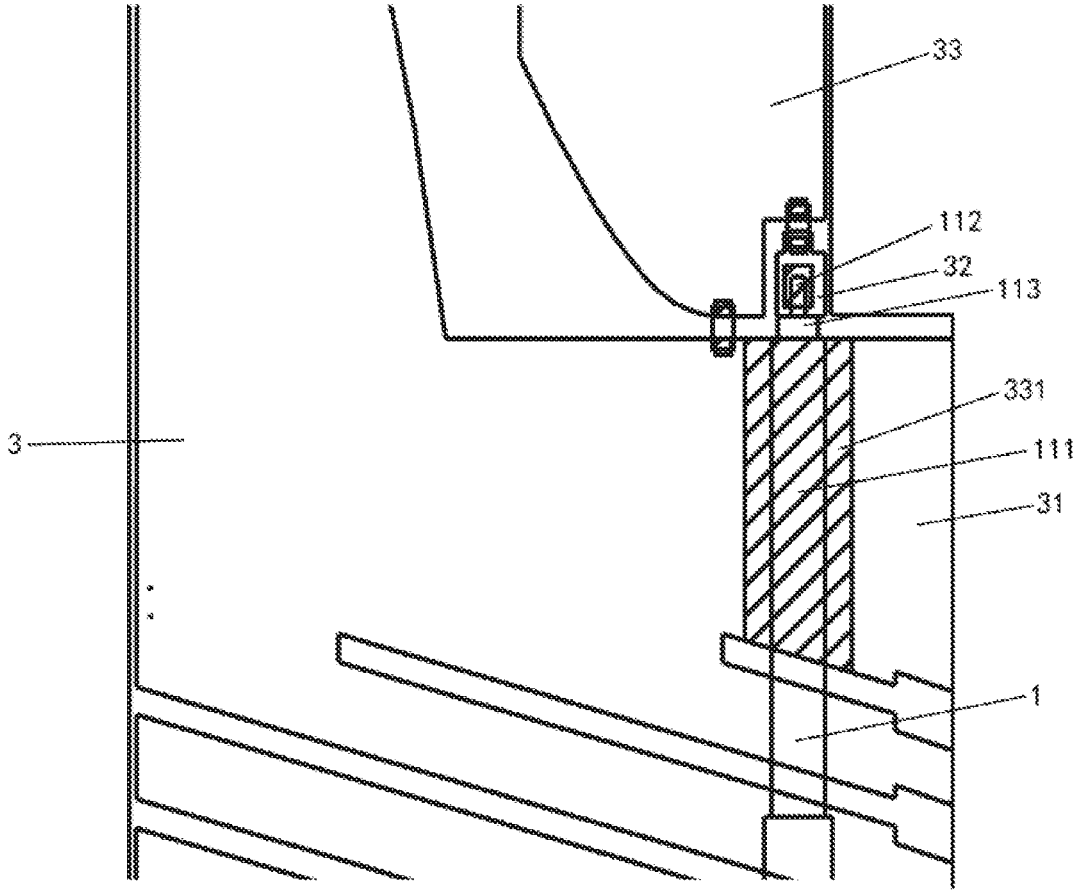
FIG. 9 is an enlarged view of a part C of FIG. 8.

The flexible circuit board 3, as shown in FIG. 2, has a flexible substrate 34 and a conductive layer 31, 32, 33 including a first conductive portion 31, a second conductive portion 32, and a third conductive portion 33 disposed on the flexible substrate 34. The flexible substrate 34 is attached on a back surface of the conductive layer 31, 32, 33 by an adhesive for example. In the shown embodiment, the conductive layer 31, 32, 33 is patterned through a processes such as photoresist coating, exposure, development, etching and the like, to form the first conductive portion 31, the second conductive portion 32, and the third conductive portion 33, which are disconnected from each other. The flexible substrate 34 is exposed at positions where the first conductive portion 31, the second conductive portion 32, and the third conductive portion 33 are disconnected from each other. A plurality of first bonding pads 331, as shown in FIGS. 2, 6, and 9, are formed on the first conductive portion 31, the second conductive portion 32 and the third conductive portion 33, respectively. At least one of the first conductive portion 31 and the third conductive portion 33, as shown in FIGS. 1 and 5, is provided with at least one slot 332 therein. As shown in FIGS. 3 and 13, both edges of the flexible circuit board 3 extending in the axial direction are further provided with second bonding pads 35.

Figure 10:
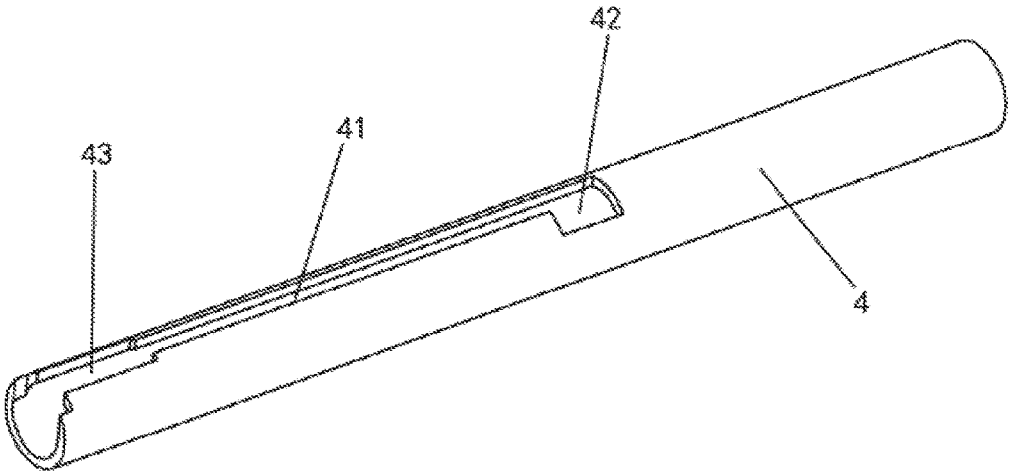
FIG. 10 is a perspective view of a support tube of the external antenna.

The support tube 4 is shown in FIG. 10. The support tube 4 has a first notch 41 extending in an axial direction. The support tube 4 also has a second notch 42 disposed approximately centrally on the support tube 4 at an end of the first notch 41. The support tube 4 also has a third notch 43 disposed at an end of the support tube 4. The support tube 4 is formed of an insulative material.

Figure 14:
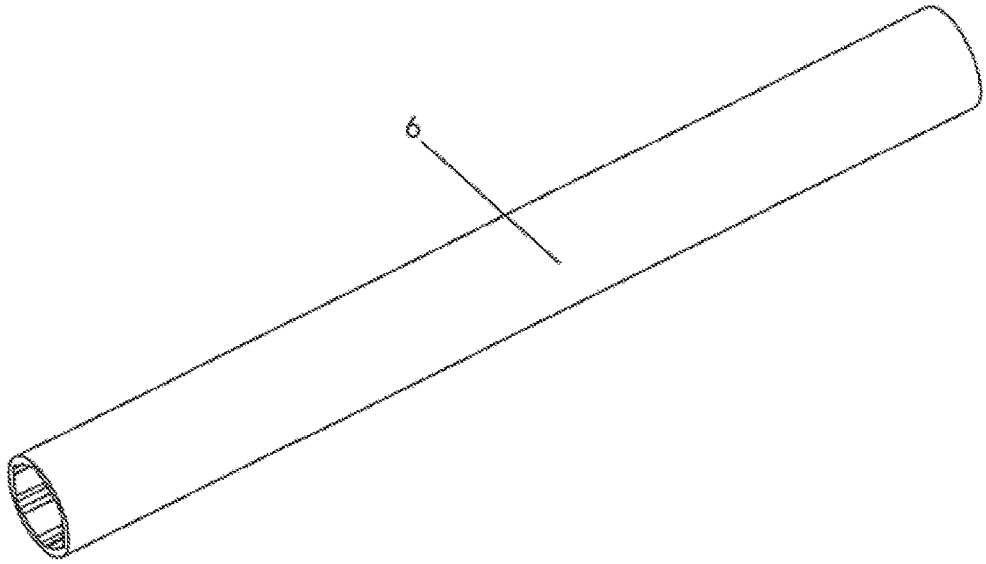
FIG. 14 is a perspective view of a protection tube of the external antenna.

The protection tube 6 is shown in FIGS. 14 and 15. The protection tube 6 is a hollow cylindrical member.

The assembly of the external antenna 100 will now be described in greater detail.

The passive element 2, as shown in FIGS. 5, 6, 8, and 9, is connected onto the flexible circuit board 3 through surface mount technology (SMT) by being mounted directly onto a surface of the printed circuit board 3. The external conductor 111 and the internal conductor 112 of the coaxial conductor assembly 1 are electrically connected with the passive element 2 via the flexible circuit board 3 so as to form an antenna loop having signal transmitting and receiving functions.

The first conductive portion 31, as shown in FIGS. 6 and 9, is electrically connected with a first end of the inductive element 22 and the external conductor 111 of the coaxial cable 11, the second conductive portion 32 is electrically connected with the internal conductor 112 and a first end of the capacitive element 21, and the third conductive portion 33 is electrically connected with a second end of the inductive element 22 and a second end of the capacitive element 21. In an alternative embodiment, the inductive element 22 is connected between the second conductive portion 32 and the third conductive portion 33, and the capacitive element 21 is connected between the first conductive portion 31 and the third conductive portion 33. The capacitive element 21, the inductive element 22, the external conductor 111 and the internal conductor 112 are bonded or soldered to corresponding first bonding pads 331 respectively to form the antenna loop. The external conductor 111 and the internal conductor 112 of the coaxial cable 11 are used as two terminals of the antenna loop. The shape and number of the slot 332 may be designed such that an operation frequency range of the antenna loop may be determined by the flexible circuit board 3 having the slot 332, the capacitive element 21, and the inductive element 22.

Figure 11:
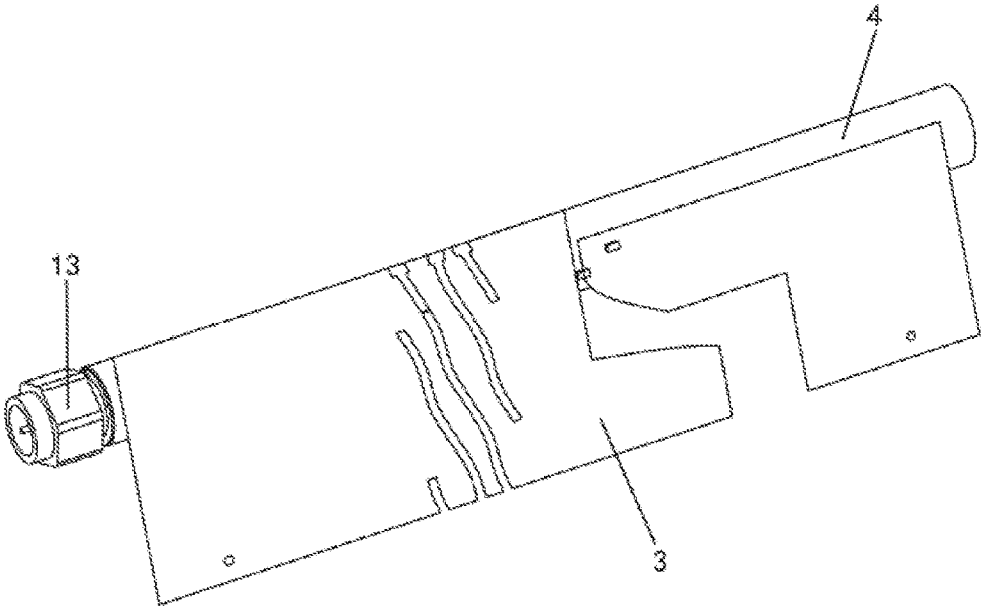
FIG. 11 is a perspective view of the flexible circuit board of FIG. 8 mounted on the support tube.

As shown in FIG. 11, the coaxial conductor assembly 1 attached to the flexible circuit board 3 is mounted within the support tube 4 through the first notch 41. In this way, the coaxial conductor assembly 1 will not occupy any space outside the support tube 4 so that a surface of the flexible circuit board 3 is closely attached onto the support tube 4, thereby reducing a size of the external antenna 100 such that an external profile of the external antenna 100 is more compact. Generally, the capacitive element 21 has a relatively larger external size with respect to the inductive element 22, so the capacitive element 21 is placed within the second notch 42. In this way, it is possible to further reduce the external size of the external antenna and allow the capacitive element to have a stable electrical property. The third notch 43 allows the insulation cylinder 13 to pass through the third notch 43 to enter an interior of the support tube 4.

Figure 12:
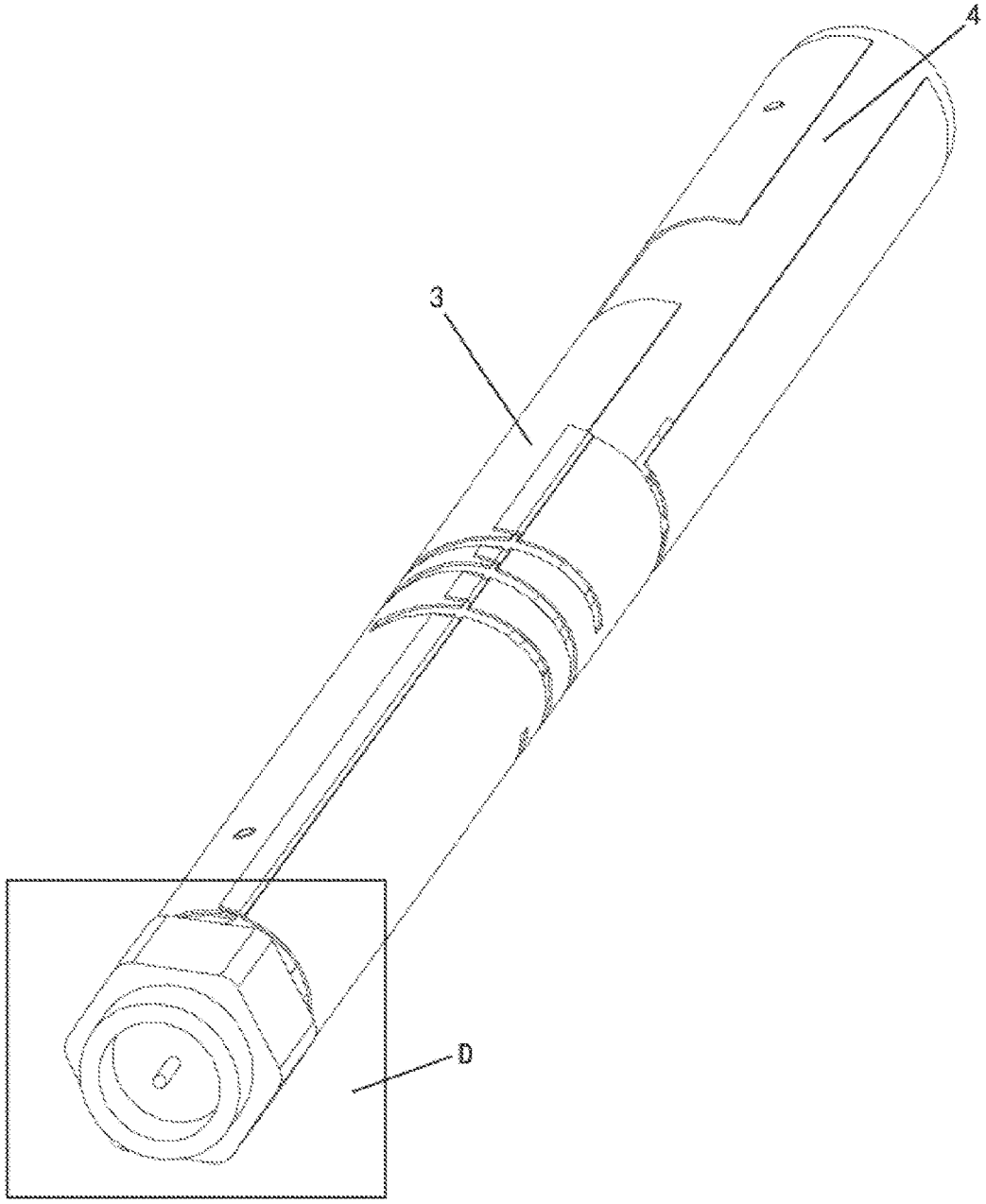
FIG. 12 is a perspective view of the flexible circuit board of FIG. 8 wound around the support tube.

The flexible circuit board 3 connected with the coaxial conductor assembly 1, as shown in FIG. 11-13, is wound around the support tube 4 having a predetermined rigid and flexibility. In this way, it is possible to allow the external antenna 100 to be bendable in a certain range relative to an axial direction. As shown in FIG. 13, both edges of the flexible circuit board 3 are abutted with each other and mechanically fixed together through soldering at the second bonding pads 35. In this way, it is possible to effectively prevent the adhesive coated on the back surface of the flexible substrate 34 from being disadhered, so that the flexible circuit board 3 is firmly fixed onto the cylindrical surface of the support tube 4.

As shown in FIG. 14, the protection tube 6 is mounted outside the flexible circuit board 3 and the support tube 4 to protect the flexible circuit board 3. The protection tube 6 may extend onto the insulation cylinder 13 and may be fixed onto the insulation cylinder 13 by, for example, an adhesive.

The external antenna 100 may be applied to a portable electronic device such as a mobile phone, a tablet, a laptop or the like. The external antenna 100 is connected with an antenna interface of an electronic device (not shown) via the mounting fitting 12. The internal threads of the conductive cylinder 122 engage with external threads of the antenna interface of the electronic device.

A method for manufacturing an external antenna according to another embodiment will now be described in greater detail. The method for manufacturing an external antenna comprises the steps of: providing the coaxial conductor assembly 1, which has the coaxial cable 11 including the external conductor 111 and the internal conductor 112 insulated from the external conductor 111 through an insulation layer 113; attaching at least one passive element 2 onto the flexible circuit board 3; electrically connecting the external conductor 111 and the internal conductor 112 with the passive element 2 by the flexible circuit board 3 to form an antenna loop; and winding the flexible circuit board 3 around the support tube 4. After winding the flexible circuit board 3 around the support tube 4, the protection tube 6 is mounted around the flexible circuit board 3 to protect the flexible circuit board 3.

The step of attaching the passive element 2 onto the flexible circuit board 3 comprises dividing, through the aforementioned patterning process, the conductive layer 31, 32, 33 of the flexible circuit board 3 into the first conductive portion 31, the second conductive portion 32 and the third conductive portion 33 which are insulated from each other such that a portion of the flexible substrate 34 is exposed. In this way, the portions of the conductive layer 31, 32, 33 disconnected from each other will keep in fixed shapes and states so as to maintain good electrical properties during subsequent processes.

The step of attaching at least one passive element 2 onto the flexible circuit board 3 comprises electrically connecting the first end of the inductive element 22 to the first conductive portion 31; electrically connecting the internal conductor 112 and the first end of the capacitive element 21 to the second conductive portion 32; and electrically connecting the second end of the inductive element 22 and the second end of the capacitive element 21 to the third conductive portion 33.

Advantageously, in the external antenna 100 and method for manufacturing the external antenna 100 according to the invention, the flexible circuit board 3, the passive element 2, the external conductor 111, and the internal conductor 112 form an antenna loop, improving the operating frequency range of the external antenna 100. The capacitive element 21, the inductive element 22 and the slot 332 provide the external antenna 100 with operation frequencies in a full band range conforming with a 4G communication standard. Further, the external antenna 100 has a relative high sensitivity, thereby improving an application range of the external antenna 100. Additionally, the external antenna 100 has a compact structure and can meet a certain bending requirement as whole without affecting its performance. The method for manufacturing the external antenna 100 is also simple, which reduced the cost of an electronic device including the external antenna 100.

What is claimed is:

1. An external antenna, comprising:

a coaxial conductor assembly having a coaxial cable including an external conductor and an internal conductor insulated from the external conductor;

a flexible circuit board having, a flexible substrate and a conductive layer, the conductive layer further having a first conductive portion, a second conductive portion, and a third conductive portion, the conductive layer disposed on the flexible substrate connected with the coaxial conductor assembly;

a passive element having:

a capacitive element, further having a first end and a second end, the first end electrically connected with the second conductive portion and the internal conductor, and an inductive element, further having a first end electrically connected to the first conductive portion and the external conductor and a second end electrically connected with the third conductive portion and the second end of the capacitive element, the passive element attached to the flexible circuit board and electrically connected to the external conductor and the internal conductor, the external conductor, the internal conductor, the flexible circuit board, and the passive element forming an antenna loop; and a support tube around which the flexible circuit board is wound and wherein the coaxial conductor assembly is mounted within the support tube through a first notch of the support tube extending in an axial direction.

2. The external antenna of claim 1, wherein the support tube has a second notch within which the capacitive element is disposed.

3. The external antenna of claim 1, wherein at least one of the first conductive portion and the third conductive portion has a slot.

4. The external antenna of claim 1, further comprising bonding pads disposed on two edges of the flexible circuit board extending in an axial direction.

5. The external antenna of claim 1, wherein the coaxial conductor assembly has a mounting fitting mounted on the coaxial cable, the mounting fitting connected with an antenna interface of an electronic device.

6. The external antenna of claim 5, wherein the mounting fitting has a conductive ferrule electrically connected with the internal conductor and a conductive cylinder into which the coaxial cable is partially inserted, the conductive cylinder electrically insulated from the conductive ferrule and electrically connected with the external conductor.

7. The external antenna of claim 6, wherein the coaxial conductor assembly has an insulation cylinder fitted over the conductive cylinder.

8. The external antenna of claim 1, further comprising a protection tube mounted around the flexible circuit board.

9. A method for manufacturing an external antenna, comprising:

providing a coaxial conductor assembly having a coaxial cable including an external conductor and an internal conductor insulated from the external conductor;

attaching a passive element onto a flexible circuit board and dividing a conductive layer of the flexible circuit board into a first conductive portion, a second conductive portion and a third conductive portion which are insulated from each other and electrically connecting a first end of an inductive element of the passive element to the first conductive portion, electrically connecting the internal conductor and a first end of a capacitive element of the passive element to the second conductive portion, and electrically connecting a second end of the inductive element and a second end of the capacitive element to the third conductive portion;

electrically connecting the external conductor and the internal conductor with the passive element, the external conductor, the internal conductor, the flexible circuit board, and the passive element forming an antenna loop; and winding the flexible circuit board around a support tube.

10. The method of claim 9, wherein the coaxial conductor assembly is mounted within the support tube through a first notch of the support tube extending in an axial direction.

11. The method of claim 10, wherein the support tube has a second notch within which the capacitive element is disposed.

12. The method of claim 9, further comprising forming a slot in at least one of the first conductive portion and the third conductive portion through a patterning process.

13. The method of claim 9, wherein the winding step comprises bonding two edges of the flexible circuit board extending in an axial direction together by bonding pads formed on the two edges of the flexible circuit board.

14. The method of claim 9, wherein further comprising mounting a protection tube around the flexible circuit board.

* * * * *